United States Patent [19]

Fritz

[11] Patent Number: 4,768,723

[45] Date of Patent: Sep. 6, 1988

[54] JAW CRUSHER

[76] Inventor: Stewart J. Fritz, 6935 E. Wilshire Dr., Scottsdale, Ariz. 85257

[21] Appl. No.: 443,290

[22] Filed: Nov. 22, 1982

[51] Int. Cl.[4] ..... B02L 1/02

[52] U.S. Cl. ..... 241/268; 241/264

[58] Field of Search ..... 241/262–273

[56] References Cited

U.S. PATENT DOCUMENTS 3,062,131 11/1962 Mankki et al. ..... 241/268 X 3,709,440 1/1973 Kontz ..... 241/262 X 3,894,698 7/1975 Falk ..... 241/264

*Primary Examiner*—Timothy V. Eley

*Attorney, Agent, or Firm*—Don J. Flickinger

[57] ABSTRACT

A jaw-type crusher for reducing the size of particulate material and which localizes the stress of operation, the crusher comprising a frame, a fixed jaw supported by the frame, an operatable jaw movably carried by the fixed jaw in opposition thereto and actuating means for imparting relative movement between jaws.

14 Claims, 3 Drawing Sheets

FIG. 1
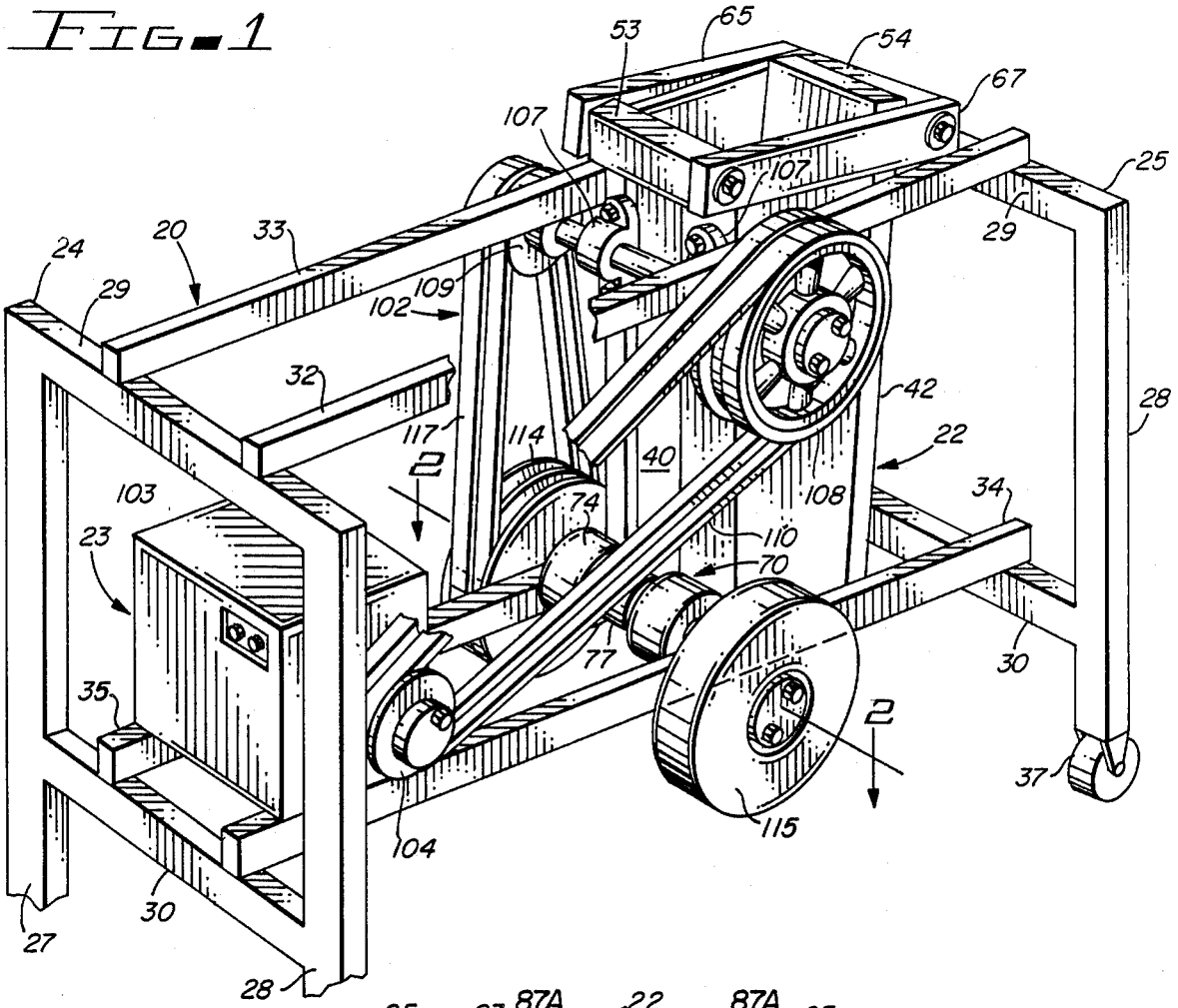
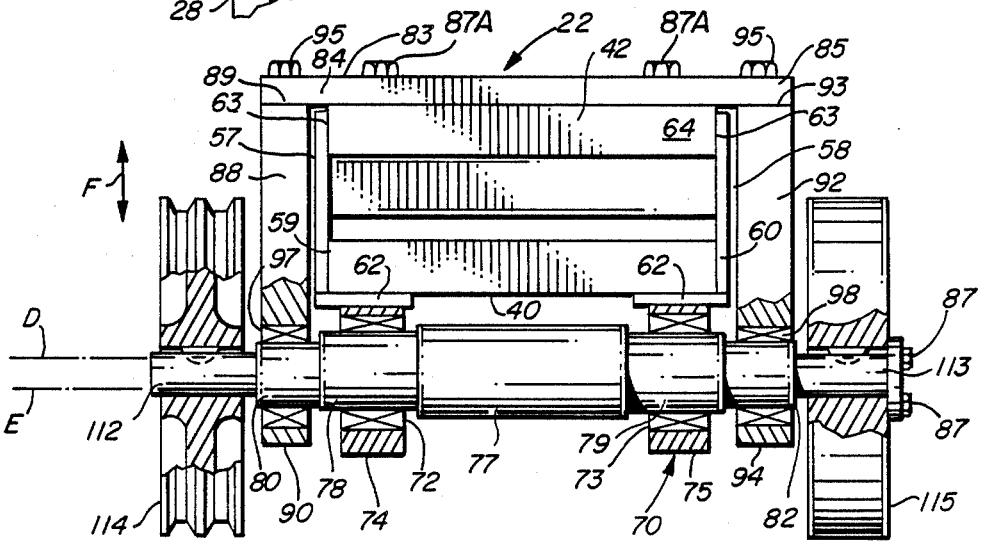
FIG. 2

JAW CRUSHER

FIELD OF THE INVENTION

This invention relates to materials processing equipment.

In a further aspect, the present invention relates to machinery for comminution of frangible material.

More particularly, the instant invention concerns an improved jaw-type crusher, especially adapted for the fracturing of ores.

PRIOR ART

Extracting valuable minerals from ore entails a plurality of sequentially performed operations. Prior to the chemical refining treatments, the ore is prepared by a series of mainly physical processes. One of the preliminary processes is comminution, breaking or fracturing the ore into a size that will release or at least expose the valuable mineral particles. Crushing and grinding are the principle comminution techniques.

Initial crushing of ore as mined is accomplished in various devices. Roll, gyratory and jaw are the common types of primary crushers. In the roll crusher, the ore is fractured between a pair of opposed rolls. The relative motion produced by the gyration of a cone eccentrically mounted within an inverted frusto-conical case serves to break ore in the gyratory crusher.

The jaw crusher includes a pair of opposed elongate jaws which are oriented to provide a wedge shaped space therebetween. Ore entering the space, known as the gape, at the top of the jaws is compressed and crushed, the fragments falling to a lower portion of the wedge to be re-crushed. The cycle is repetitive until the fragments are of a sufficiently reduced size to pass through the opening at the bottom of the jaws. The distance between the bottom of the jaws, which determines maximum particle size, is referred to as the set.

Typically, one of the jaws is stationarily secured to a supporting frame. The other jaw is movably affixed, usually by a hinge at the top or at the bottom of the jaw, to the frame, and caused to move in response to a toggle-plate arrangement. Extending between the jaw and the frame and driven by a pitman extending from an eccentric, the toggle-plate arrangement imparts generally oscillatory motion to the operable jaw. The distance of movement of the operable jaw relative the fixed jaw is termed the throw.

For various reasons the conventional prior art jaw crusher has proven to be less than entirely satisfactory. Tremendous force is generated during the ore crushing action between the jaws. Since each jaw is independently supported, the stress is transmitted through the frame. Accordingly, an unduly heavy reinforced frame is imperative.

The drive mechanism tends to be relatively encumbered. Pivotal connections are required between the toggle-plates and the pitman and between the respective toggle-plates and the frame and the operable jaw. Due to diminished retracting ability the toggle-plate arrangement is commonly assisted by a return spring.

It would be highly advantageous, therefore, to remedy the foregoing and other deficiencies inherent in the prior art.

Accordingly, it is an object of the present invention to provide an improved crusher for breaking ore.

Another object of the invention is the provision of an improved crusher of the jaw type.

And another object of the invention is to provide a crusher in which the stresses are localized within the jaw structure.

Still another object of the immediate invention is the provision of a jaw type crusher of comparatively light weight.

Yet another object of the invention is to provide a relatively unencumbered device.

And a further object of this invention is the provision of a jaw crusher having improved actuating means.

Still a further object of the invention is to provide simplified yet effective jaw actuating means.

Yet a further object of the instant invention is the provision of a jaw crusher of substantially compact design.

Yet still another object of the invention is to provide a jaw crusher having a selectively variable set.

And yet a further object of the invention is the provision of a crusher according to the foregoing that is duriably, yet relatively inexpensively, manufactured.

SUMMARY OF THE INVENTION

Briefly, to achieve the desired objects of the instant invention in accordance with a preferred embodiment thereof, first provided is a frame having a fixed jaw supported therby. An operable jaw is spaced from and movably carried by the fixed jaw. The jaws are oriented to provide a wedge shaped space there between, the wider portion of the wedge shaped space being proximate the top of the jaws and defining the gape while the narrower portion proximate the lower end of the jaws defines the set. Actuating means imparts relative movement between the jaws for crushing particulate material.

In a further embodiment, the operable jaw is movably affixed to the fixed jaw by suspension means including a link pivotly connected at first and second ends to the fixed jaw and the operable jaw, respectively. The actuating means includes motion translation means carried by the fixed jaw for imparting reciprocal movement to the operable jaw and drive means carried by the frame for imparting movement to the motion translation means.

In yet a further embodiment, means are provided for selectivity varying the set.

BRIEF DESCRIPTION OF THE DRAWINGS

The foregoing and further and more specific objects and advantage of the instant invention will become readily apparent to those skilled in the art from the following detailed description of preferred embodiments thereof taken in conjunction with the drawings in which:

FIG. 1 is a perspective view of a crusher constructed in accordance with the teachings of the instant invention, portions thereof being broken away for purposes of illustration;

FIG. 2 is an enlarged horizontal sectional view taken along the line 2—2 of FIG. 1;

DESCRIPTION OF THE PREFERRED EMBODIMENTS

Figure 3:
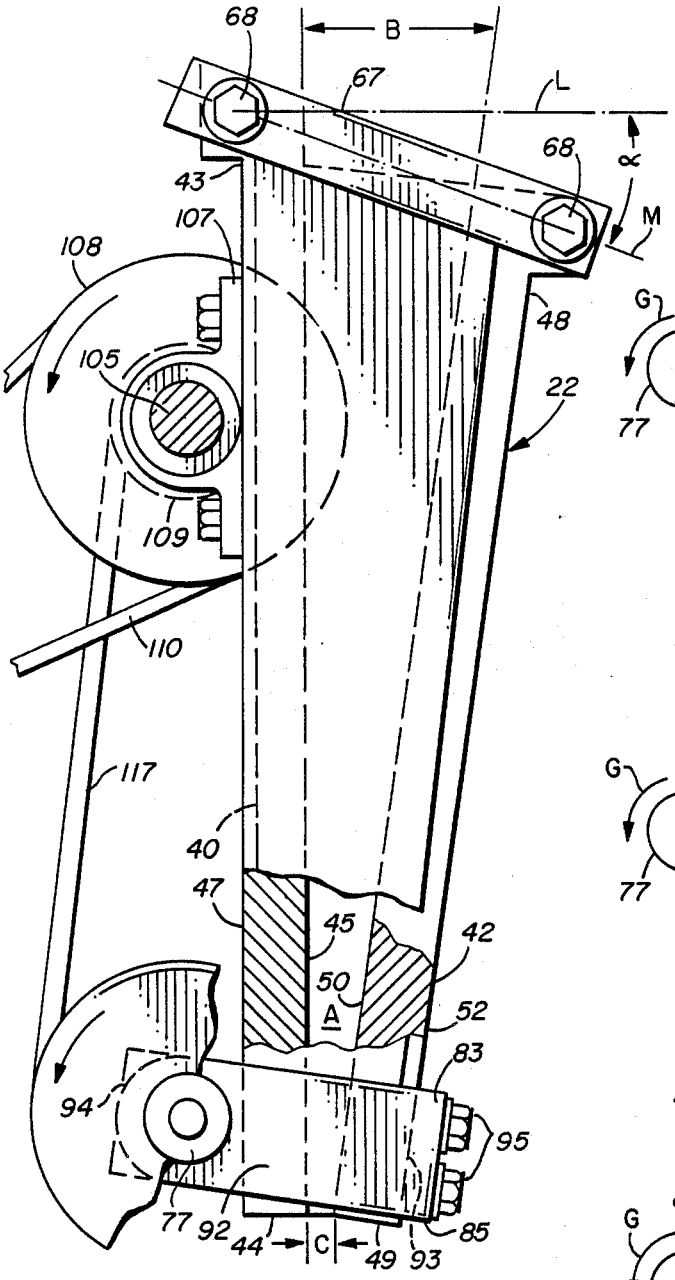
FIG. 3 is an enlarged fragmentary side elevational view of the jaw portion of the crusher of FIG. 1, portions thereof being broken away for purposes of illustration.

Turning now to the drawings in which like reference characters indicating corresponding elements throughout the several views, attention is first directed to FIG. 1 which illustrates a preferred embodiment of the crusher of the instant invention including frame, jaw assembly and actuating means generally designated by the reference characters 20, 22, and 23, respectively. Details of the components and the cooperation therebetween for the purpose of crushing and breaking ore and other frangible material will become apparent to those skilled in the art as the description proceeds.

Frame 20 includes a pair of spaced apart end members 24 and 25 each having upright elements 27 and 28 tied together by upper lateral element 29 and lower lateral element 30. A pair of upper longitudinal elements 32 and 33 and a pair of lower longitudinal elements 34 and 35 extend between end members 24 and 25. Each upright element 27 and 28 terminates, at the lower end, with a rotatably mounted ground support wheel 37.

Preferably, frame 20 is fabricated as a weldment of standard commercially available channel or box section structural metallic elements. For ease of manufacture, the end members 24 and 25 may be identical, as are the upper and lower longitudinal elements. Wheel 37 may assume the form of a caster for greater mobility of the device or, alternately, be replaced by a mounting pad or foot for permanent or semipermanent placement.

Jaw assembly 22, as further seen in FIGS. 2 and 3, includes fixed jaw 40 and operable jaw 42. Fixed jaw 40, being generally elongate in the upright direction and preferably fabricated of steel plate, includes upper end 43, lower end 44, inner or face surface 45 and outer or back surface 47. Similarly, operable jaw 42 includes upper and lower ends 48 and 49, respectively, and face and outer surfaces 50 and 52, respectively. Element 53, for purposes of reinforcing and mounting, projects outwardly from surface 47 and extends laterally proximate upper end 43 of fixed jaw 40. A similar element 54 is correspondingly affixed to operable jaw 42. A pair of substantially parallel side plates 57 and 58, bearing against the upright edges 59 and 60, respectively, project from fixed jaw 40 in the direction of operable jaw 42. For purposes of mounting, each side plate 57 and 58 may terminate with a longitudinally extending inwardly directed flange 62 embracing and secured to the back surface 47 of fixed jaw 40. The upright edges 63 of operable jaw 42 are movably received between side plates 57 and 58.

A pair of links 65 and 67 extend between jaws 40 and 42 proximate the respective upper ends 43 and 48. The links 65 and 67 lie outboard of the respective side plates 57 and 58. Further, the ends of the links are pivotally secured to the respective jaws. In accordance with the immediately preferred embodiment of the invention, one end of each link is secured to the ends of element 53 by a shoulder bolt 68. The other end of each link is similarly affixed to the ends of the element 54. The use of shoulder bolts to affect a pivotal connection is well known to those skilled in the art of metal fabrication.

Fixed jaw 40 is immovably supported by frame 20. Fixed jaw 40 and the attached side plates 57 and 58 are, for example, readily welded to the longitudinal elements 32, 33, 34 and 35. Operable jaw 42 is carried by fixed jaw 40, being movably suspended by the links 65 and 67. Face surface 50 of operable jaw 42 is angularly opposed to face surface 45 of fixed jaw 40, defining a generally wedge-shaped space A therebetween. The wider portion, represented by the distance B, of the wedge-shaped space A, being at the upper end of the jaw assembly 22, defines the inlet opening commonly referred to as the "gape". Wedge-shaped space A converges from the gape to the discharge opening, or "set", at the lower end of jaw assembly 22 and represented by the distance C. Further description of the immediate elements, including relative motion between the jaws, will be made presently.

Actuating means 23 includes motion translation means, generally designated by the reference character 70, carried by fixed jaw 40 for imparting reciprocal motion to operable jaw 42, as will now be described with particular reference to FIGS. 2 and 3. A pair of spaced apart aligned bearings 72 and 73 are carried proximate the lower end 44 of fixed jaw 40 such as by conventional, commercially available pillow blocks 74 and 75 affixed to surface 47 in accordance with practice common in the art. Drive shaft 77 is rotatably mounted in bearings 72 and 73 by journals 78 and 79, respectively. Journals 78 and 79 are aligned for rotation of shaft 77 about a longitudinal geometric axis, represented by the broken line D which is substantially parallel to face surface 50 of operable jaw 42. Journals 78 and 79 may, for purposes of discussion, be considered concentric journals.

Journals 80 and 82 are formed on shaft 77 outboard of journals 78 and 79, respectively. Journals 80 and 82, which may be referred to as eccentric journals, are aligned along a longitudinal axis, represented by the broken line E, parallel and spaced from the axis of journals 78 and 79. For purposes of graphic representation, the distance between the broken line representing the axis D and the broken line representing the axis E is exaggerated.

Bar 83, affixed to surface 52 of jaw 42 proximate lower end 49, is transverse with terminal end portions 84 and 85 extending beyond side plates 57 and 58. Bar 83 is affixed, in accordance with conventional technique, by bolts 87A extending through bar 83 and threadedly engaged with jaw 42. Arm 88, having first end 89 and second end 90 and arm 92 having first end 93 and second end 94 communicate between bar 83 and shaft 77. First end 89 of arm 88 is secured to terminal end portion 84 of bar 83 by bolts 95. Similarly, terminal end portion 85 of bar 83 is secured to first end 93 of arm 92 by bolts 95. Bearing 97, carried proximate the second end 90 of arm 88, rotatably receives journal 80. Journal 82 is fitted within bearing 98 carried proximate the second end 94 of arm 92.

As shaft 77 rotates, arms 88 and 92 are caused to oscillate in reciprocal directions as indicated by the double arrowed line F, which movement is transmitted to operable jaw 42. Further description of the movement of jaw 42 will be made presently. The lengths of arms 88 and 92, the distance from the axis of bearings 97 and 98 as indicated by the broken line E, and the respective first ends 89 and 93, respectively, determine the set as previously designated by the reference character C. The above described arrangement provides for an alterable set. Placement of shims between ends 89 and 93 and the respective terminal end portions 84 and 85 of bar 83 increases the set. Placement of shims between bar 83 and surface 52 of jaw 42 decreases the set.

Drive means, generally designated by the reference character 102 as seen in FIG. 1, is the component of actuating means 23 for imparting motion to the previously described motion translation means generally designated by the reference character 70. In accordance with the immediately preferred embodiment of the invention, drive means 102 includes electric motor 103 secured to frame 20, specifically mounted upon lower longitudinal elements 34 and 35. Drive pulley 104 is affixed to the output shaft of electric motor 103. The mounting of drive pulley 104 upon the output shaft of electric motor 103, leads for supplying electric energy to motor 103, motor controlling switches and other immediate details will be readily apparent to those skilled in the art. It will also be appreciated by those skilled in the art that electric motor 103 may be replaced by other power elements, such as a gasoline engine, as required to satisfy the needs of the immediate user.

Idler shaft 105, as further seen in FIG. 3, is rotatably affixed to the back surface 47 of fixed jaw 40 by a pair of spaced apart pillow blocks 107. Pillow blocks 107, which in actuality bear against flanges 62, support shaft 105 at a location spaced from shaft 77 and in an orientation substantially parallel thereto. Input idler pulley 108 and output idler pulley 109 are keyed or otherwise drivingly mounted upon respective ends of shaft 105. A pair of drive belts 110 encircle and transmit rotational force between drive pulley 104 and input idler pulley 108.

Journal 112 and journal 113, formed on shaft 77 outboard of journals 80 and 82, respectively, are aligned with the geometric axis represented by the broken line D. Driven pulley 114 is mounted upon journal 112. Flywheel 115 is mounted upon journal 113. A pair of belts ll7,encircling pulleys 109 and 114, transmit rotation from shaft 105 to shaft 77.

The drive transmitting belts 110 and 117, as shown in the embodiment chosen for purposes of illustration, are utilized in pairs over double groove pulleys or sheaves. The multibelt arrangement adequately transmits driving force throughout the actuating means. It is within the teachings of the present invention that the size and number of belts be varied in accordance with the power requirements of the jaw assembly. Further, selective belt tensioning adjusted to slip at a predetermined load of the jaw assembly, adequately provides overload protection. In accordance with standard procedure, as will be apparent to those skilled in the art but not herein specifically illustrated, pillow blocks 107 are vertically movable upon fixed jaw 40 and motor 103 is horizontally movable upon frame 20 for tensioning of the belts.

The function of the device previously set forth in connection with FIGS. 1-3 will now be described in greater detail with reference to the schematic illustrations of FIGS. 4A through 4D and FIG. 5. Shaft 77 rotates continuously in the direction represented by the curved arrow designated by the reference character G. The double ended arrow designated by the reference charater F and illustrating movement of operable jaw 42 in FIG. 2, has a first component in the direction of arrowed line H and a second component in the direction of arrowed line I. Operable jaw 42 is also movable in first and second directions as graphically represented by first and second arrowed lines J and K. For purposes of discussion, eccentric journals 80, 82 can be considered to pass through four successive quadrants in response to the rotation of shaft 77. Each quadrant includes 90° of travel, the approximate midpoint of each successive quadrant being graphically represented by the location of journal 82 in FIGS. 4A through 4D, respectively.

Figure 4A:
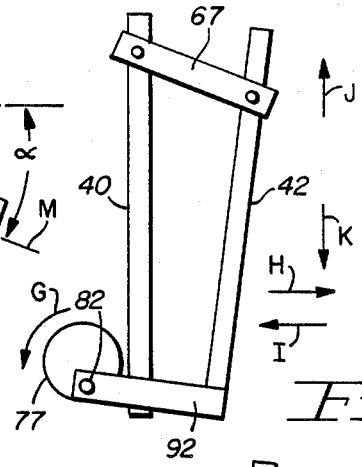
FIGS. 4A through 4D are a sequencial schematic representation of the operation of the jaw portion seen in FIG. 3.
Figure 4B:
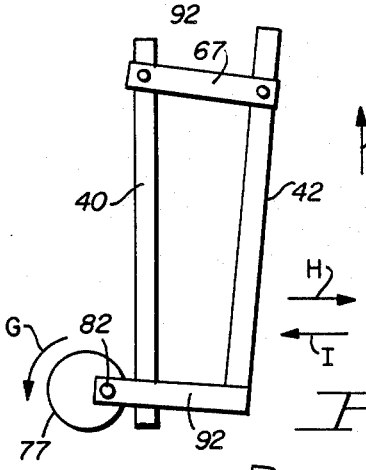

In the first quadrant, as seen in FIG. 4A, the arms 88 and 92 move in the combined direction of arrowed lines H and J. The component of movement in the direction of arrowed line H is substantially greater than the component of movement in the direction of arrowed line J. Corresponding movement is imparted to operable jaw 42. As the journals 80 and 82 pass through the second quadrant, as seen in FIG. 4B, motion of jaw 42 continues in the same directions. However, the component in the direction of arrowed line J increases as the component in the direction of arrowed line H decreases and reverses to the direction of arrowed line I.

Figure 4C:
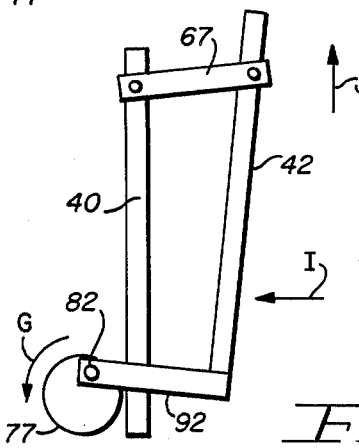
Figure 5:
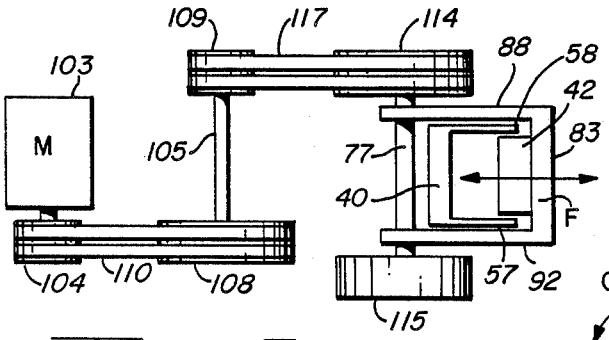
FIG. 5 is a semi-schematic top view of the device of FIG. 1.
Figure 4D:
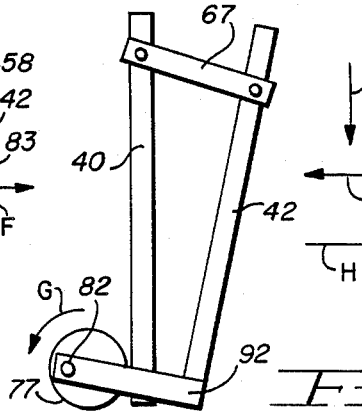

As viewed in FIG. 4C, journals 80 and 82 pass through the third, or upper, quadrant continuing motion in the direction indicated by the arrowed line I. Motion in the direction of arrowed line K replaces motion in the direction of arrowed line J. Movement in the direction of arrowed line J continues as the offset journals 80, 82 move through the terminal quadrant of one revolution. In the immediate quadrant, the component of movement in the direction of arrowed line I decreases and is replaced by an increasing component of movement in the direction of arrowed line H.

In the foregoing description, movement in the direction of arrowed lines H and J represent return strokes. Movement in the direction of arrowed lines K and I are power strokes, combining to break or fracture particulate material between the jaws 40 and 42. The speed of rotation of shaft 77 determines frequency. The throw of operable jaw 42, represented by the double arrowed line F, is determined by the offset of journals 80, 82 as represented by the distance between the axes represented by broken lines D and E, said distance being one-half of the throw.

Frequency and throw are defined terms within the art.

In addition to simple crushing action, as a result of movement in the direction of arrowed line I, the device of the instant invention has a second action upon the material. This action, which may be described as bite, urges the material downwardly against the fixed jaw 40. The bite is a functional movement in the direction of arrowed line K, and to a lesser extent, to movement in the direction of arrowed line I. Bite is a function of the angle alpha seen in FIG. 3 and defined as lying between a horizontal line represented by the reference character L passing through the axis of shoulder bolt 68 at fixed jaw 40 and an intersecting line designated by the reference character M passing through the axis of shoulder bolt 68 at fixed jaw 40 and the axis of shoulder bolt 68 at the operable jaw 42. The greater the angle alpha, the greater the movement in the direction of arrowed lines J and K and consequently, the greater bite. Angle alpha is selectively variable in accordance with selective positioning of mounting elements 53 and 54 and the corresponding attachment of shoulder bolts 68. It is noted that during the foregoing described movement, side plates 57 and 58 retain the particulate material within the jaw assembly. Further, the jaws may be provided with teeth, such as spaced rows of horizontal weld beads, to reinforce the bite and further urge the material downwardly.

Figure 6:
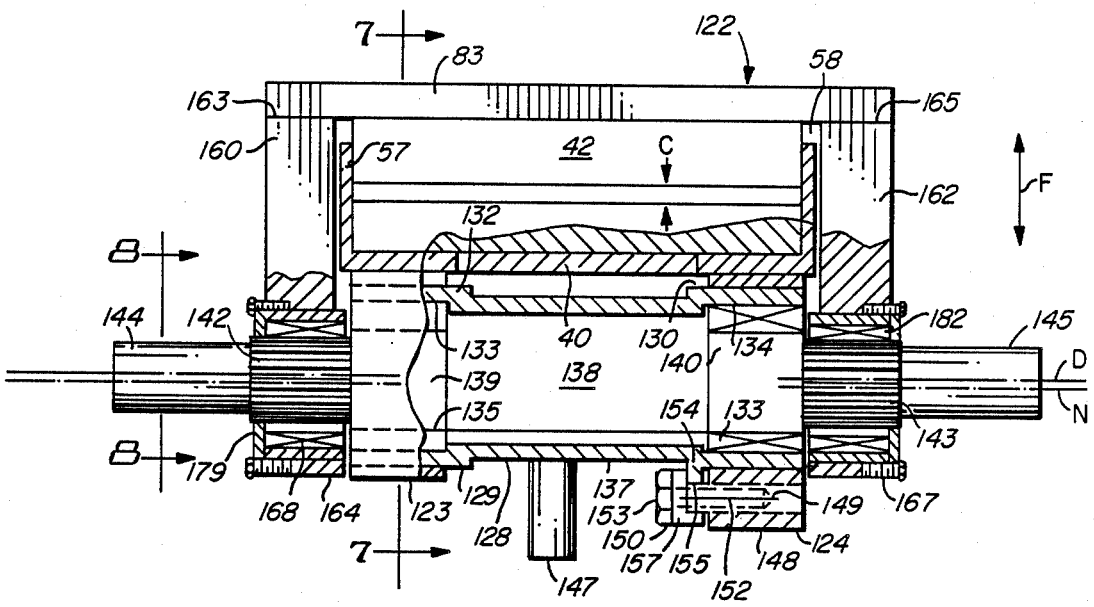
FIG. 6 is an illustration generally corresponding to the view of FIG. 2 and showing an alternate embodiment of the invention, portions of the view being broken away for purposes of illustration.

Attention is now directed to FIG. 6 which illustrates an alternate jaw assembly, generally designated by the reference character 122, and usable in connection with the previously described device of the instant invention. In general similarity to the previously described jaw assembly 22, the instant assembly includes fixed jaw 40 having side plates 57 and 58 extending therefrom and operable jaw 42 having bar 83 affixed thereto. Jaw assembly 122, which is securable to frame 20 and operatively associated with actuating means 23 in lieu of jaw assembly 22, in all aspects not specifically illustrated is similar to jaw assembly 22 except for the motion translation portion which is set forth below.

Figure 7:
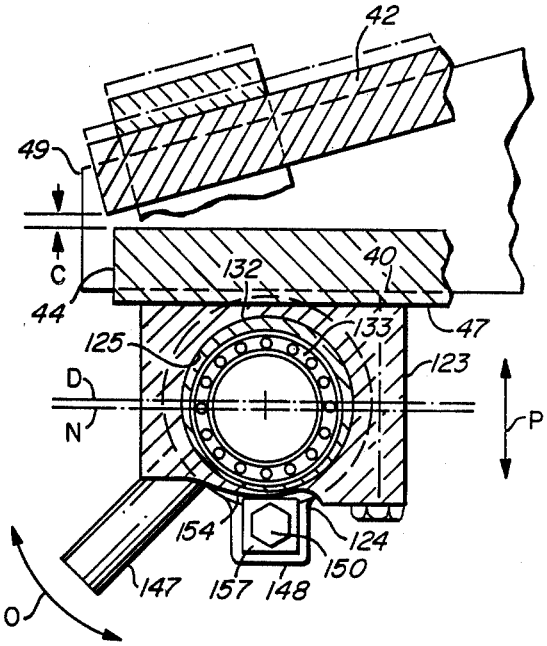
FIG. 7 is a fragmentary vertical sectional view taken along the lines 7—7 of FIG. 6.

A pair of spaced apart pillow blocks 123 and 124, as further illustrated in FIG. 7, is secured to back surface 47 of fixed jaw 40 in lieu of pillow blocks 74 and 75. Bore 125, concentric with the geometric axis represented by the broken line D, extends through pillow blocks 123 and 124. Tubular bearing housing 127 includes intermediate section 128 residing between end sections 129 and 130. Each end section 129 and 130 carries a portion of journal 132 which is rotatably received within bore 125. Counterbores 133 and 134, aligned along an eccentric axis represented by the broken line designated by the reference character N, are formed in end sections 129 and 130, respectively. Eccentric axis N is spaced from the geometric axis D and parallel to said axis D and the previously described eccentric axis E. Bearings 135 and 137 are carried within the counterbores 133 and 134, respectively.

Drive shaft 138 extends through bearing housing 127. Aligned journals 139 and 140 are received within bearings 135 and 137, respectively, for rotation of shaft 138. Generally cylindrical sections 142 and 143 reside outboard of journals 139 and 140, respectively. Shaft 138 terminates at one end with journal 144 for receiving driven pulley 114. At the other end, shaft 138 terminates with journal 145 which is sized to receive flywheel 115. Journals 139, 140, 144 and 145 are aligned for rotation about the longitudinal or geometric axis of shaft 138. Generally cylindrical sections 142 and 143, aligned along a common axis, are eccentric to the journals as will be further described presently.

A handle 147 extends radially from the intermediate section 128 of bearing housing 127. Boss 148, having threaded bore 149 extending therethrough along an axis substantially parallel to the axis of shaft 138, projects from pillow block 124. Bolt 150 includes threaded shank 152 matingly engaged within bore 149 and head 153. Flange 154 projects radially from bearing housing 127. Outer edge 155 is generally arcuate along a line concentric with the axis of shaft 138, to reside in close proximity to shank 152 under head 153 of bolt 150 as bearing housing 127 is rotated. As will be seen presently, flange 154 need not be continuous but should extend for approximately 180° L-shaped locking tab 157 resides between head 153 and flange 154.

Bearing housing 127 is rotated within pillow blocks 123 and 124 in response to movement as indicated by the arcuate double ended arrowed line O. Bearing housing 127 is retained at any rotatably selected location in response to tightening of bolt 150 which clamps flange 154 between locking tab 157 and pillow block 124. In response to the rotation of housing 127, the eccentric axis N of counterbores of 133 and 134 is caused to move arcuately about axis D, which movement includes a component indicated by the double arrowed line P as seen in FIG. 7. The component of movement represented by the double arrowed line P coincides with the direction of movement of operable jaw 42 designated by the double arrowed line F in FIG. 6. Accordingly, the set, designated by the reference character C in FIG. 6, is infinitely variable throughout a range equal to twice the distance of the offset between the axis of bore 125 and the axis of counterbores 133 and 134.

Figure 8:
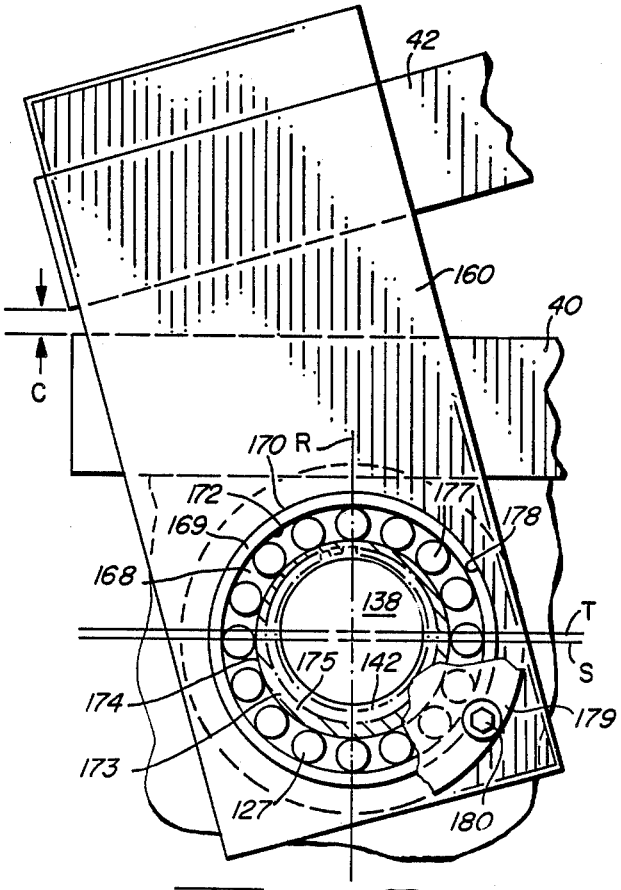
FIG. 8 is a fragmentary vertical sectional view taken along the line 8—8 of FIG. 6.

With reference to FIG. 6 and 8, there is seen means for selectively adjusting the throw or stroke of operable jaw 42 by selectively varying the offset of the eccentric journaling of arms 160 and 162 on shaft 138. Arm 160 concludes with first end 163 and second 164 while arm 162 terminates with first end 165 and second end 167. In general similarity to arms 88 and 92, second ends 163 and 165 of arms 160 and 162, respectively, are secured to respective terminal portions of bar 83. Drive shaft 138 is rotatably journaled proximate the second ends 164 and 167.

Bearing 168 interfaces between arm 160 and splined cylindrical section 142 of shaft 138. Typical of frictionless bearings, bearing 168 includes outer race 169 having outside diameter 170 and inside diameter 172 and inner race 173 having outside diameter 174 and inside diameter 175. A plurality of rollers 177 reside between the inside diameter 172 of outside race 169 and the outside diameter 174 of inner race 173. The outside diameter 170 of outer race 169 is removably received within bore 178 formed through arm 160 about an axis parallel to the geometric axis of shaft 138. The inside diameter 175 of inner race 173 is splined to matingly receive splined cylindrical section 142. Annular retainer plate 179 removably affixed to arm 160 by a plurality of spaced bolts 180, retains bearing 168 within bore 178.

Inside diameter 175 of inner race 173 is eccentric relative the outside diameter 174. In other words, the axis of inside diameter 175 is displaced from the axis of outside diameter 174. In FIG. 8 the axis of outside diameter 174 is represented by the innersection of the broken lines designated by the reference characters R and S while the axis of inside diameter 75 is represented by the intersection of the broken lines R and T. The axis of cylindrical section 142 is displaced from the geometric axis of shaft 138 by an equal distance, represented by the distance between the broken lines designated D and N. The effective eccentricity of cylindrical section 142 is selectivity variable throughout a range having a minimum eccentricity of O and a maximum eccentricity of the combined distance between axes D and E and T and S. The degree of eccentricity is selectivity variable in response to selective positioning of splined inside diameter 175 of inner race 173 upon splined cylindrical section 142. Bearing 168 is readily removable from bore 178 and cylindrical section 142 when retainer plate 179 is removed. The throw of jaw 142 is directly proportional to the combined offset between the foregoing described pair of axes. The foregoing description is also applicable to bearing 182, interfacing between arm 162 and cylindrical section 142, which must be positioned and adjusted corresponding to the placement of bearing 168.

Various changes and modifications to the embodiment herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the present invention, and alternately preferred embodiments thereof, in such clear and concise terms as to enable those skilled in the art to understand and practice the same, the invention claimed is:

1. A jaw-type crusher for reducing the size of particulate material, said crusher including a jaw structure to which the stress of operation is localized, said crusher comprising:

a. a frame;
b. a fixed jaw supported by said frame;
c. an operable jaw opposing said fixed jaw;
d. suspension means carried by said fixed jaw for movably supporting said movable jaw and including a link having
   i. a first pivotal connection to said fixed jaw, and
   ii. a second pivotal connection to said operable jaw, said second pivotal connection being spaced from said first pivotal connection; and
e. actuating means for imparting relative movement between said jaws.

2. The crusher of claim 1, wherein said actuating means includes:

a. motion translation means carried by said fixed jaw for imparting reciprocal motion to said operable jaw; and
b. drive means providing a source of power to said motion translation means.

3. The crusher of claim 2, wherein said motion translating means includes:

a. an eccentric carried by said fixed jaw and rotatable in response to said drive means; and
b. an arm having an effective length and having
   i. a first end coupled with said eccentric having an offset, and
   ii. a second end affixed to set operable jaw.

4. The crusher of claim 3, further including set adjustment means for selectively varying the size to which said particulate material is reduced.

5. The crusher of claim 4, wherein said set adjustment means includes means for selectively varying the effective length of said arm.

6. The crusher of claim 5, wherein said set adjustment means includes adjustable attachment means for affixing the second end of said arm to said operable jaw.

7. The crusher of claim 4, wherein said set adjustment means includes:

a. a shaft carrying said eccentric and supported by said fixed jaw for rotation about a geometric axis; and
b. axis adjustment means for selectively altering the geometric axis of said shaft.

8. The crusher of claim 7, wherein said axis adjustmemt means includes:

a. a housing carried by said fixed jaw and selectively positionable about an axis of rotation; and
b. bearing means carried with said housing and journalling said shaft for rotation about an axis offset from and parallel to the axis of rotation of said housing.

9. The crusher of claim 8, further including locking means for retaining said housing at selectively obtainable positions.

10. The crusher of claim 3, further including throw adjustment means for selectively varying the distance of relative movement between said jaws.

11. The crusher of claim 10 wherein throw adjustment means includes means for selectively varying the offset of said eccentric.

12. The crusher of claim 11, wherein said throw adjustment includes:

a. a bore proximate the first end of said arm; and
b. bearing means having
   i. an outside diameter which is concentric about a first axis and is receivable within said bore, and
   ii. an inside diameter concentric about a second axis offset from said first axis for receiving said eccentric at rotatably selective positions.

13. The crusher of claim 1, further including set adjustment means for selectively varying the size to which said particulate material is reduced.

14. A jaw-type crusher for reducing the size of particulate material and for localizing the stress of operation, said crusher comprising:

a. a frame;
b. a fixed jaw supported by said frame;
c. an operable jaw movably carried by said fixed jaw in opposition thereto;
d. actuating means for imparting relative movement between said jaws; and
e. throw adjustment means for selectively varying the distance of relative movement between said frames.

* * * * *